US006776245B2

(12) United States Patent
Kristen et al.

(10) Patent No.: US 6,776,245 B2
(45) Date of Patent: Aug. 17, 2004

(54) ELECTRICAL HAND-HELD POWER TOOL WITH AN ELECTROPNEUMATIC PERCUSSION MECHANISM

(75) Inventors: Ferdinand Kristen, Gliching (DE); Herbert Daxenberger, Herrshing (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/270,940

(22) Filed: Oct. 15, 2002

(65) Prior Publication Data

US 2003/0070823 A1 Apr. 17, 2003

(30) Foreign Application Priority Data

Oct. 15, 2001 (EP) ..... 01811005

(51) Int. Cl.[7] ..... B25D 17/20

(52) U.S. Cl. ..... 173/217; 173/210; 173/109; 173/171; 173/DIG. 2

(58) Field of Search ..... 173/216, 217, 173/DIG. 2, 171, 109, 117, 201; 310/47, 50

(56) References Cited

U.S. PATENT DOCUMENTS

| | | | | | |
|---|---|---|---|---|---|
| 2,155,082 | A | * | 4/1939 | Decker | 173/217 |
| 2,456,571 | A | * | 12/1948 | Turner et al. | 173/217 |
| 2,517,882 | A | * | 8/1950 | Johnson | 173/217 |
| 5,052,497 | A | * | 10/1991 | Houben et al. | 173/109 |
| 5,099,160 | A | * | 3/1992 | Strozel et al. | 310/47 |
| 6,127,751 | A | * | 10/2000 | Kristen et al. | 310/50 |
| 6,325,157 | B1 | * | 12/2001 | Arakawa et al. | 173/201 |
| 6,543,549 | B1 | * | 4/2003 | Riedl et al. | 173/DIG. 2 |

* cited by examiner

*Primary Examiner*—Scott A. Smith
(74) *Attorney, Agent, or Firm*—Sidley Austin Brown & Wood, LLP

(57) ABSTRACT

An electrical hand-held power tool including a percussion assembly (3) with a percussion mechanism (2) and displaceable, substantially vibration-free, in an outer housing (6) provided with a plurality of aeration openings (4) and at least one cooling conduit (7) connecting the aeration openings (4) with a cooling ventilator (5) and securable on the percussion assembly (3).

3 Claims, 2 Drawing Sheets

ELECTRICAL HAND-HELD POWER TOOL WITH AN ELECTROPNEUMATIC PERCUSSION MECHANISM

BACKGROUND OF THE INVENTION

1. Field of the Invention

The present invention relates to a percussion electrical hand-held power tool such as hammer drill, combination hammer drill, and chisel hammer including an electropneumatic mechanism, preferably, for abrasive removal of stone material.

2. Description of the Prior Art

In electrical hand-held power tools of the type described above, an electrical energy generated by an electromotor is transformed by suitable mechanical means into an axially percussion and, optionally, rotational movement that is force- and form-lockingly transmitted to a working tool for performing a corresponding work.

In electromechanical percussion mechanisms, the only ones considered here, mechanical energy, which is generated primarily by an electric motor, is transmitted by an eccentric to an oscillating drive piston and from the drive piston by a gas spring to a percussion piston. The percussion piston transmits the mechanical percussion energy to an anvil which transmits it to an oscillating and rotating working tool. The repeated compression and expansion of the gas column of the gas spring generates, because of thermodynamic processes that take place, heat which has to be dissipated into environment by heat conductance and heat convection.

German Publication DE 32 05 063 A1 discloses cooling of an electrical hand-held power tool with cooling air which is aspirated through the aeration openings provided in the tool housing by a cooling ventilator of the tool electric motor. The air flows through the pneumatic percussion mechanism and through the hollow space between the percussion assembly and the housing.

German Publication DE 196 00 339 C1 discloses a percussion hand-held power tool in which different air channels are provided between the outer housing and drive and transmission units.

U.S. Pat. No. 4,353,425 discloses a percussion hand-held power tool the guide tube of which is thermally isolated from the outer housing by an air gap.

A percussion-driven working tool, which alternatively acts on a workpiece and which is preloaded by a tool user applying pressure to a handle that is secured to the tool housing, causes axial oscillations of the handle which should be eliminated to a most possible extent. Because of sealing problems resulting from housing parts being movable relative to each other, no cooling channels can be formed between these housing parts. As a result, a partial short-circuiting of the cooling stream takes place and which reduces the cooling output.

German Publication DE 34 05 922 discloses a percussion hand-held tool which includes a percussion assembly displaceable substantially vibration-free in the outer housing and separately from a handle secured to the housing.

An object of the present invention is to provide an electric hand-held power tool the percussion mechanism of which, displaceable substantially vibration-free in the housing, is adequately cooled.

SUMMARY OF THE INVENTION

This and other objects of the present invention, which will become apparent hereinafter, are achieved by providing an electrical hand-held power tool including an outer housing having a plurality of aeration openings, a percussion assembly displaceable in the outer housing substantially vibration-free and having a percussion mechanism, a cooling ventilator located in the outer housing, and at least one cooling conduit connecting the aeration openings with the cooling ventilator and secured on the percussion assembly.

By securing the cooling conduit on the percussion assembly, all of the sealing problems between the substantially vibration-free displaceable by about 10 mm, percussion assembly and the outer housing are eliminated. The elimination of the sealing problems permitted to eliminate the cooling output-reducing short-circuiting between the air inlet and the air outlet of the cooling ventilator.

Advantageously, at least one substantially annular, air-conducting cooling collar is connected to an end of the cooling conduit.

Advantageously, the cooling collar has a plurality of openings distributed over its circumference. Thereby, the cooling stream entering the outer housing through the aeration openings is distributed over the circumference.

The novel features of the present invention, which are considered as characteristic for the invention, are set forth in the appended claims. The invention itself, however, both as to its construction and its mode of operation, together with additional advantages and objects thereof, will be best understood from the following detailed description of a preferred embodiment, when read with reference to the accompanying drawings.

DETAILED DESCRIPTION OF THE PREFERRED EMBODIMENT

Figure 1:
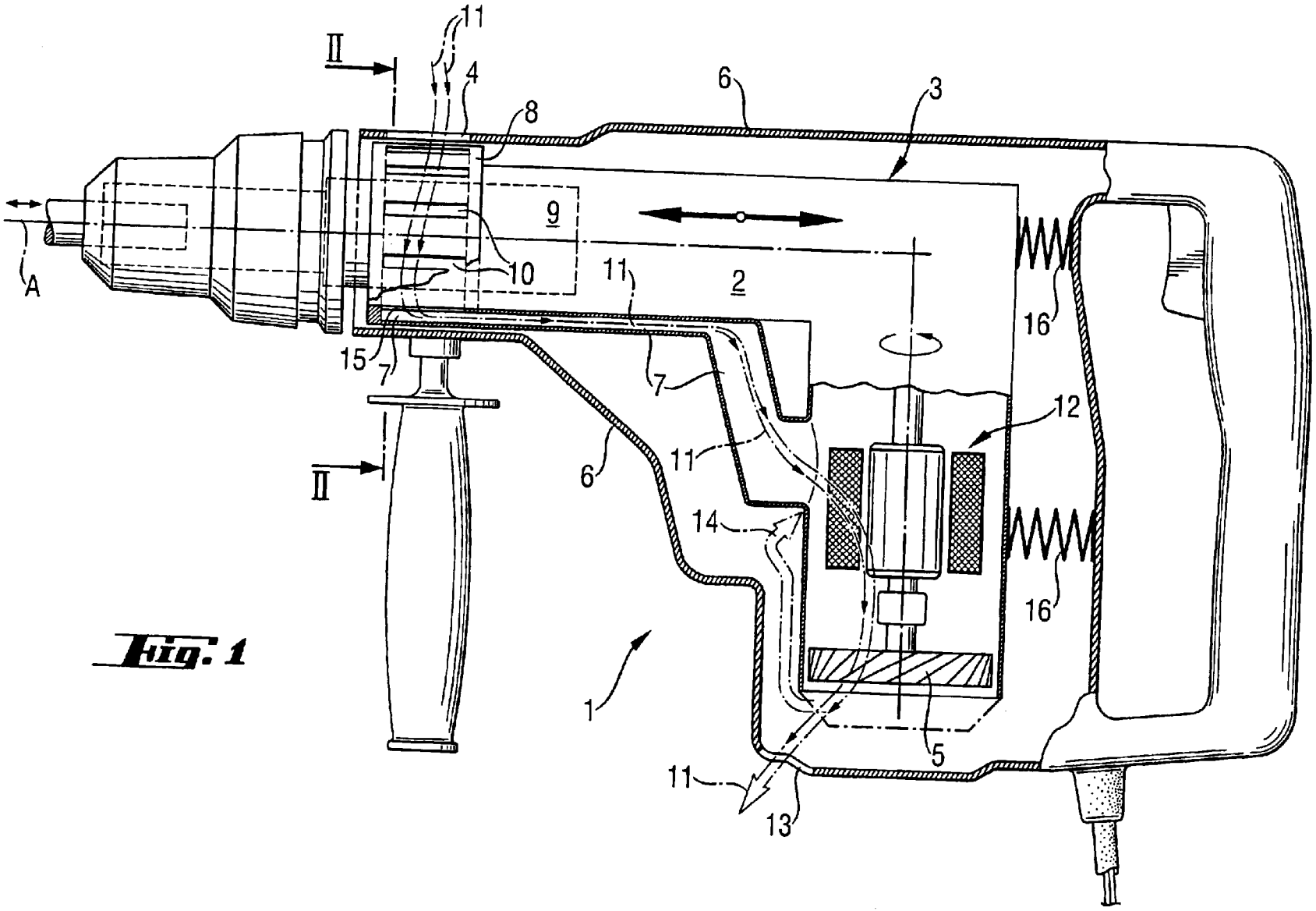
FIG. 1 shows a cross-sectional view of an electrical hand-held power tool according to the present invention.

An electrical hand-held power tool according to the present invention, which is shown in FIG. 1, includes an outer housing 6 and a percussion assembly 3 displaceable in the outer housing 6 and having an electropneumatic percussion mechanism 2. An elastic suspension, springs 16 dampen the vibrations of the percussion assembly 3 relative to the outer housing, insures a substantially vibration-free displacement of the percussion assembly. The outer housing 6 is provided with aeration openings 4 which are connected with a cooling ventilator 5, which is located in the outer housing 6, by a cooling conduit 7. The cooling conduit 7 is secured on the percussion assembly 3. An end of the cooling conduit 7 is connected with an annular, cooling, air conducting collar 8 secured adjacent to a gas spring 9 of the percussion mechanism 2. The cooling collar 8 has a plurality of openings 10 which are located in vicinity of aeration openings 4 formed in the outer housing 6 and through which air stream 11 flows, through the cooling conduit 7, to the electromotor 12, further to the cooling ventilator 5, and to the air outlet openings 13 formed in the outer housing 6 and located behind the cooling ventilator 5, without the return flow 14 leading to the air flow being short-circuited.

Figure 2:
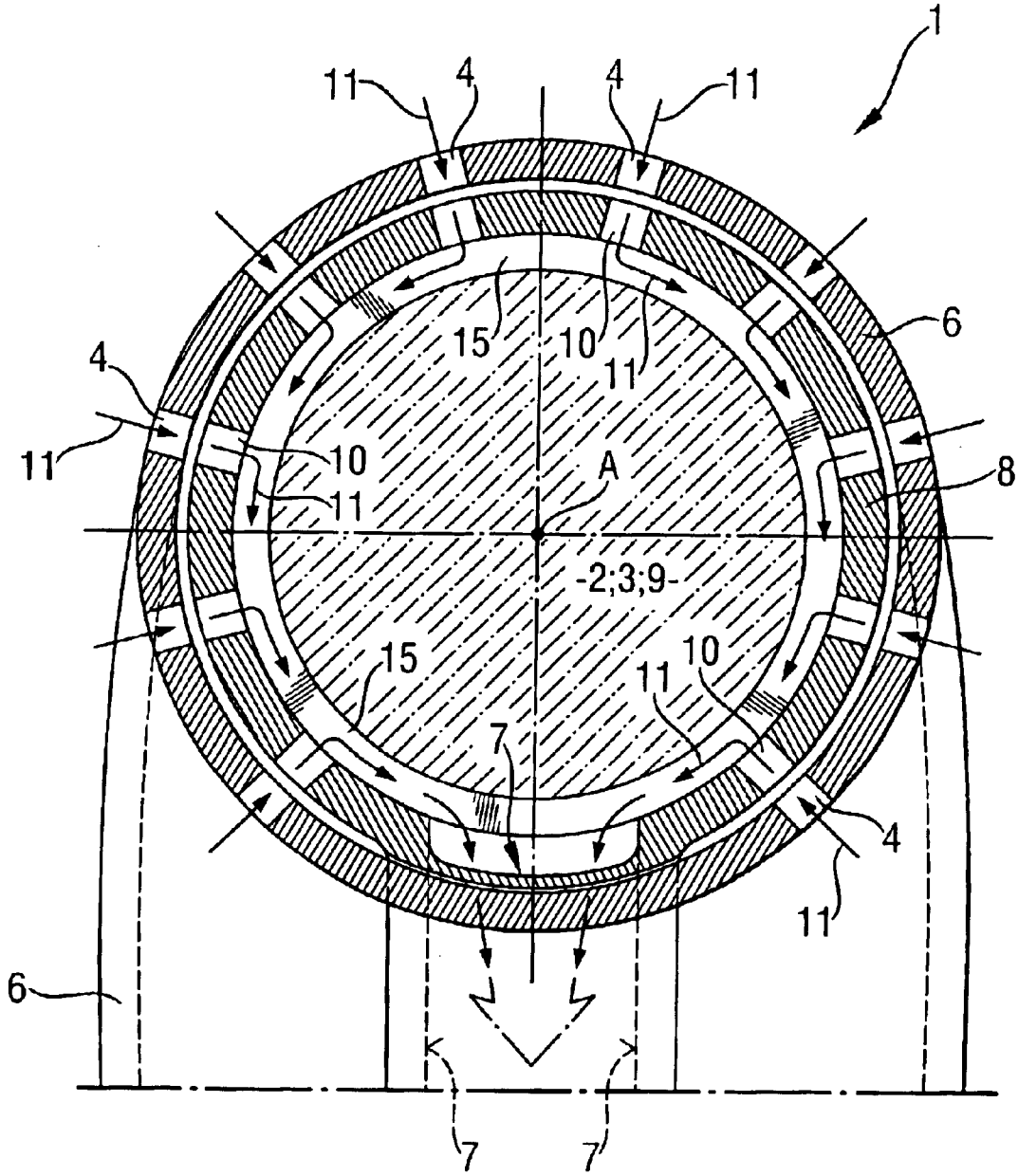
FIG. 2 shows a cross-sectional view along line II—II in FIG. 1 at an increased, in comparison with FIG. 1, scale.

As shown in FIG. 2, the circumferentially distributed openings 10 of the collar 8, which is concentrically secured on the percussion assembly 3, are connected with the cooling conduit 7 by an annular channel 15. The air stream

11 enters the housing 6 through the aeration openings 4 and through the openings 20, which are associated with respective openings 4, the air reaches the cooling conduit 7.

Though the present invention was shown and described with references to the preferred embodiment, such is merely illustrative of the present invention and is not to be construed as a limitation thereof, and various modifications tot he present invention will be apparent to those skilled in the art. It is, therefore, not intended that the present invention be limited to the disclosed embodiment or details thereof, and the present invention includes all of various and/or alternative embodiments within the spirit and scope of the present invention as defined by the appended claims.

What is claimed is:

1. An electrical hand-held power tool, comprising an outer housing (6) having a plurality of aeration openings (4); a percussion assembly (3) displaceable in the outer housing (6) substantially vibration-free and having a percussion mechanism (2); means (16) located in the outer housing for supporting the percussion assembly (3) for a substantially vibration-free displacement relative to the outer housing (6); a cooling ventilator (5) located in the outer housing (6); and at least one cooling conduit (7) connecting the aeration openings (4) with the cooling ventilator (5) and secured on the percussion assembly (3).

2. An electrical hand-held power tool according to claim 1, further comprising at least one, substantially annular, air-conducting cooling collar (8) connected to an end of the cooling conduit (7).

3. An electrical hand-held power tool according to claim 2, wherein the cooling collar (8) has a plurality of openings (10) distributed over its circumference.

* * * * *